United States Patent [19]

Moran

[11] Patent Number: 4,555,348

[45] Date of Patent: Nov. 26, 1985

[54] LIQUID BUFFER SYSTEM

[75] Inventor: James C. Moran, Taylors, S.C.

[73] Assignee: Sybron Chemicals Inc., Birmingham, N.J.

[21] Appl. No.: 625,755

[22] Filed: Jun. 28, 1984

[51] Int. Cl.[4] ..... C09K 3/00; D06P 1/00

[52] U.S. Cl. ..... 252/1; 252/182; 436/18; 8/532; 8/584; 8/929

[58] Field of Search ..... 252/182, 1; 436/18; 8/101, 636, 139, 543, 532, 584, 929; 423/299, 308, 312

[56] References Cited

U.S. PATENT DOCUMENTS

| | | | |
|---|---|---|---|
| 2,178,550 | 11/1939 | Acree | 436/18 |
| 3,022,926 | 2/1962 | Bailey | 223/76 |
| 3,129,052 | 4/1964 | Dawson | 8/54 |
| 3,920,400 | 11/1975 | Scheibe et al. | 436/18 |
| 4,051,056 | 9/1977 | Hartman | 252/99 |
| 4,063,877 | 12/1977 | Elliot et al. | 8/1 A |

OTHER PUBLICATIONS

"The Theory and Practice of Wool Dyeing", by C. L. Bird, The Soc. of Dyers and Colourists, Dean House, Piccadilly, 1963.

*Primary Examiner*—Teddy S. Gron
*Assistant Examiner*—Virginia B. Caress
*Attorney, Agent, or Firm*—Robert A. Gerlach; Owen D. Marjama

[57] ABSTRACT

Monosodium phosphate is highly soluble in water and can be used as an ingredient for a low pH liquid buffer in a concentration of about 13–40 percent by weight. Tri potassium phosphate has good solubility in water and is a suitable ingredient for a high pH liquid buffer in a concentration of about 20–50 percent by weight. By a combination of these two ingredients, a system has been developed for using liquid buffer mixes in place of solid phosphate buffers, especially for use as a direct textile bath additive.

5 Claims, No Drawings

LIQUID BUFFER SYSTEM

BACKGROUND OF THE INVENTION

This invention relates to the use of liquid ingredients to provide a pH setting and/or buffering system that is beneficial to the preparation, treating, dyeing, printing and finishing of textile materials such as fiber, yarn, fabric and carpet. The invention also has utility in non-textile industrial operations where processing in water systems occurs, as a replacement and improvement for solid phosphate pH setting and/or buffer ingredients.

For the proper treatment in dyeing and finishing of textile materials, it is the practice to select a pH range that is best suited to the particular operation. These operations can be carried out in water at various temperatures or by application of water suspended or dissolved ingredients directly onto the material. pH is a term used to express a measure of acidity or alkalinity. The pH in these operations can fluctuate widely and if not controlled can cause erratic results. To control pH fluctuations, chemicals are added to the liquid treating bath. Such chemicals used to set or control pH fluctuations are called buffers.

Preparation, treating, dyeing, printing and finishing of textile material such as fiber, yarn, fabric, and carpet involves placing the textile material into a vessel containing water and various compounds dispersed, dissolved, emulsified, or suspended in the water for the purpose of creating the desired effects on the textile material. This water based mixture is called the bath.

The specific process may require a short term immersion in the bath, such as a padding operation in the finishing or preparation area. In this case, the material is run continuously through a trough containing the bath with a dwell time of only a few seconds. The material is then often squeezed dry by means of nip rolls. In other cases, the material is left immersed in the bath for long periods of time (up to 12 hours) to allow chemicals in the bath to act on the textile substrate. Various conditions of temperature, acidity, alkalinity, etc. may be used to produce the desired effects on the material.

Some examples of typical chemicals which may be contained in a textile bath are listed below:

| | | | |
|---|---|---|---|
| Preparation: | surfactants<br>hydrogen peroxide<br>sodium hydroxide<br>silicate<br>stabilizers<br>pH neutralizers<br>(buffers) | Finishing: | resin finish<br>hand builder<br>softener<br>lubricant<br>pH control<br>agents (buffers) |
| | | Printing: | acrylic<br>polymers<br>thickeners<br>pH control<br>agents (buffers)<br>dyestuffs or<br>pigments<br>surfactants<br>oils<br>softeners |
| Dyeing: | surfactant<br>solvent swelling<br>agents<br>pH control agents<br>(buffers)<br>salt<br>softener<br>lubricants<br>Dyestuffs<br>Thickeners | | |

-continued

| |
|---|
| Defoamers |

Among the commonly used materials for buffering and/or setting pH are Monosodium Phosphate (MSP), Disodium Phosphate (DSP), and Trisodium Phosphate (TSP). These materials are solids, and users have been faced with difficulties in the measuring, handling and dissolving of these materials. For example, these solid products are commonly packaged in 50 or 100 pound bags. These bags must be manually lifted and opened, a procedure that often results in strained muscles, spill waste from broken bags, and poor control over material usage. These powders must then be diluted in a premixing tank before being fed into the textile processing equipment. This is a time consuming operation, and unless the employees involved in the powder dilution are very conscientious, lumps of undissolved product may flow into the equipment or drain lines can clog with solid particles.

These difficulties associated with handling solid phosphates-spillage, lost time from physical strain, disposal or empty bags, time spent in dividing operating difficulties because of incompleted dissolved solids-are of great concern and have been a long-standing problem in dyehouse operations.

SUMMARY OF THE INVENTION

It has been discovered that the above noted prior art problems with respect to solid phosphate buffers can be eliminated by the use of liquid buffer ingredients which are easy to handle and measure, and mix readily with water.

The liquid buffer system of the present invention is designed to use a low pH liquid buffer ingredient and a high pH liquid buffer ingredient either alone or a combination of the two that will provide a pH and buffering action in a preselected range, ranging from high pH to low pH, the desired preselected pH range being considered the optimum for the particular processing operation. The high pH liquid buffer ingredient performs in the range where solid TSP (Trisodium Phosphate) is used. The low pH liquid buffer ingredient performs in the range where solid MSP (Monosodium Phosphate) is used. By a combination of the high pH liquid ingredient and the low pH liquid ingredient, the pH range of DSP (Disodium Phosphate) can be covered. Thus the use of the high pH buffer ingredient and low pH buffer ingredient serves to cover the full range that can be covered by the solid soidum phosphate buffers.

Monosodium phosphate (also sodium phosphate, monobasic) is highly soluble in water even at low temperatures and can be used as an ingredient for a low pH liquid buffer ingredient. Tri-sodium phosphate, however is not soluble enough to be considered a suitable ingredient for a high pH liquid buffer ingredient particularly for cold temperature storage. However, tri potassium phosphate (also potassium phosphate, tribasic) has good solubility in water and is a suitable ingredient for a high pH liquid buffer ingredient. By a combination of these two ingredients, a system has been developed for using liquid buffer mixes in place of solid phosphate buffers.

In carrying out the present invention, it is important to make the high pH and the low pH liquid buffer ingredients with high concentration in order to achieve product economy versus the solid phosphate buffer ingredients. The discovery of the suitability of tri potassium phosphate as a high pH buffer ingredient because of its high solubility in water is critical to the practicality of the invention. High concentration of high pH liquid buffer ingredient would not be possible using tri sodium phosphate, the usual solid high pH buffer ingredient.

DETAILED DESCRIPTION OF THE INVENTION

The liquid buffer ingredients of the present invention can be formulated over a wide range of concentration. For reasons of economy in preparation storage and shipping, the concentration of the tri potassium phosphate is usually at least about 20 up to about 50 percent by weight in water. The concentration of the monosodium phosphate is from about 13 to 40 percent by weight in water. The liquid buffer ingredients can be constituted to provide for formation of additional buffering chemicals in situ, by incorporating chemicals in the two liquid buffer ingredients that will react chemically on mixing to provide additional buffering material in solution. The high pH liquid buffer ingredient can be formulated to contain free Potassium Hydroxide in addition to tri potassium phosphate. Small amounts of sodium hydroxide may be added to enhance temperature stability of the high pH liquid buffer ingredient. The low pH liquid buffer ingredient can be formulated to contain free phosphoric acid in addition to monosodium phosphate. When the high pH liquid buffer ingredient is mixed with the low pH liquid buffer ingredient, the free potassium hydroxide and free phosphoric acid will react to form a potassium phosphate which would be a buffer formed in-situ. This would reinforce the buffering action of the tri potassium phosphate which was in the high pH liquid buffer ingredient, and the monosodium phosphate that was in the low pH liquid buffer ingredient. The reaction of this free phosphoric acid and free potassium hydroxide could be represented as an example by the following:

| | |
|---|---|
| $KOH + H_3PO_4$ | $KH_2PO_4 + H_2O$ |
| $2KOH + H_3PO_4$ | $K_2HPO_4 + 2H_2O$ |
| $3KOH + H_3PO_4$ | $K_3PO_4 + 3H_2O$ |

Any free sodium hydroxide present would react in a similar way to form comparable sodium phosphates in addition to the potassium phosphates.

The solid phosphates of the prior art give inferior buffering in the pH range of about 8 to 10. When desired, the liquid buffer ingredients can be modified by the addition of borax and/or ethanolamines to improve the buffering of the system in the range of about 8 to 10.

When used with the low pH buffer composition or ingredient, the concentration of phosphoric acid should be in the range of about 0 to 30 percent by weight, while the monoethanolamine, diethanolamine, or triethanolamine alone or in combination should be in the range of about 1.9 to 4 percent by weight.

When used with the high pH buffer composition or ingredient, the concentration of borax pentahydrate should be in the range of about 4 to 10 percent by weight. The monoethanolamine, diethanolamine, or triethanolamine alone or in combination should be in the range of about 4 to 8 percent by weight. The potassium hydroxide should be in the range of about 2.5 to 20 weight percent with a preferred range of about 4 to 9 percent being used in certain applications. Sodium hydroxide, when used, should be in the range of about 0.4 to 7 percent by weight.

The liquid buffers of the present invention are added in the range of about 0.1 to 0.3 percent by weight of the dye bath. This range is on the as is basis and is the total for the sum of low pH and high pH liquid buffers. This range applies for dyes other than fiber reactive dyes in which the liquid buffers are added in the range of about 0.25 to 1.5 percent by weight of the dye bath.

The concentration of dyes in the dye bath range from about 0.1 to 1 percent by weight. Salt ranges from about 0 to 10 percent by weight. Levelers and surfactants range from about 0 to 0.3 percent. Sequestering agents range from 0 to 0.05 percent. All percentages are by weight of the dye bath.

A typical method which may be used for making the low pH liquid buffer is as follows: Into a mixer add 55.0 parts water and stir. Then add 31.0 parts sodium phosphate, monobasic (MSP) and stir until dissolved. Then add 14.0 parts phosphoric acid. Stir until uniform and then transfer the material to a suitable container.

The high pH liquid buffer can be made as follows: Into a mixer add 56.6 parts water and stir. Then add 31.6 parts potassium phosphate tribasic (TKP) and stir to dissolve. Then add 7.9 parts potassium hydroxide and stir to dissolve. Add 3.9 parts sodium hydroxide and stir to dissolve. Cool and transfer to a suitable container. The chemicals used are corrosive and should be handled with proper precaution and with proper safety equipment.

Typical examples of seven formulations of the present invention which have been found suitable for low pH liquid buffer ingredients and for high pH liquid buffer ingredients are tabulated below in parts by weight:

| | |
|---|---|
| 1. Low pH Liquid Buffer Ingredient | |
| Sodium Phosphate, Monobasic | 15.3 parts |
| Water | 56.5 parts |
| Monoethanolamine | 1.9 parts |
| Phosphoric Acid | 26.3 parts |
| 2. Low pH Liquid Buffer Ingredient | |
| Sodium Phosphate, Monobasic | 31.0 parts |
| Phosphoric Acid | 14.0 parts |
| Water | 55.0 parts |
| 3. High pH Liquid Buffer Ingredient | |
| Potassium Phosphate, Tribasic | 42.9 parts |
| Water | 57.1 parts |
| 4. High pH Liquid Buffer Ingredient | |
| Potassium Phosphate, Tribasic | 30.1 parts |
| Borax Pentahydrate | 4.0 parts |
| Triethanolamine | 7.1 parts |
| Water | 58.8 parts |
| 5. High pH Liquid Buffer Ingredient | |
| Potassium Phosphate, Tribasic | 21.4 parts |
| Potassium Hydroxide | 2.9 parts |
| Borax Pentahydrate | 8.4 parts |
| Triethanolamine | 6.2 parts |
| Water | 61.1 parts |
| 6. High pH Liquid Buffer Ingredient, | |
| Potassium Phosphate, Tribasic | 29.2 parts |
| Potassium Hydroxide | 12.3 parts |
| Water | 58.5 parts |
| 7. High pH Liquid Buffer Ingredient | |
| Potassium Phosphate, Tribasic | 31.6 parts |
| Potassium Hydroxide | 7.9 parts |
| Sodium Hydroxide | 3.9 parts |
| Water | 56.6 parts |

A high pH liquid buffer ingredient may be used alone with certain fiber reactive dyes for the dyeing of rayon and cotton as a replacement for TSP (trisodium phosphate).

In the reactive dyeing of cellulosic textile materials, an alkaline material is needed to provide conditions that promote formation of a chemical bond between the reactive dye and the cellulosic textile material. The firm chemical bond between the dye and the cellulosic textile material is responsible for the excellent wash fastness produced on cellulosics with reactive dyes. The commonly used alkaline materials include sodium hydroxide, trisodium phosphate (TSP), sodium silicate, sodium carbonate, and sodium bicarbonate.

A high pH liquid buffer may be used as a replacement for the commonly used alkaline material in the reactive dyeing of cellulosic textile materials (e.g. rayon, cotton, flax) and blends of cellulosic textile materials with other natural or synthetic textile materials.

The high pH liquid buffer performs comparably with the commonly used alkaline materials in creating the necessary reaction conditions and in producing level full shade dyeings. In addition, less of the high pH liquid buffer on a weight basis is needed to do the same job as the optimum amount of the commonly used alkaline material. The following example illustrates an application of the use of a high pH liquid buffer in a reactive dyeing operation.

EXAMPLE I

Into a suitable dyeing beaker containing an agitator, 5 grams of bleached 100% cotton fabric, are placed in a bath of 125 ml water, 6.25 grams of common salt, and 0.2 gm Remazol Red 3FB dye (American Hoechst Company). The bath is stirred for 15 minutes, warmed to 104° F. and held for 15 minutes. Then 1.25 gm of high pH liquid buffer ingredient No. 6 are added to the bath. The bath is heated to 140° F. and held for one (1) hour and then allowed to cool to room temperature. The cotton is removed from the bath and washed thoroughly. The use of 1.25 gm of liquid buffer No. 6 in this procedure results in a dyeing of equal shade depth and fastness properties as compared with using 2.50 gm of TSP as the high pH buffer in the same procedure.

The high pH liquid buffer ingredient and low pH liquid buffer ingredient may be used together to set and hold a pH level between about 5.0 and 9.0 for a dyeing operation. The following example illustrates an application of the two buffer ingredients in a typical dyeing operation.

EXAMPLE II

Into a suitable dyeing beaker containing an agitator, 10 grams of nylon 6 tufted carpet are placed in a bath of 150 ml water. 0.1 gm leveler (Migrassist NEW) (Sybron Chemical Inc.), 0.01 gm Nylosan Red F2R (Sandoz Color & Chemical) (O) and 0.01 gm low pH liquid buffer ingredient No. 1 plus 0.14 gm high pH liquid buffer ingredient No. 5 to control the pH in the range of about 8.3 to 8.6. The use of low pH liquid buffer ingredient No. 1 and high pH liquid buffer ingredient No. 5 in this manner produces a dyed carpet of similar color yield and appearance to dyeings where MSP, TSP, diammonium phosphate, ammonium sulfate, and other solid pH buffer ingredients are used, whether separately or in conjunction with another solid or liquid pH buffer ingredient, to influence dye bath pH.

A high pH liquid buffer ingredient may be used to control the pH of a scouring bath used to remove waste and oils from fiber or fabric. The desired pH for this operation is about 8–9.5. The following example illustrates this operation.

EXAMPLE III

Into a suitable dyeing beaker containing an agitator, 25 grams of 50% polyester, 50% cotton knit are placed in a bath of 500 ml of water. Then add surfactant (Tanaterge WFF) (Sybron Chemical Inc.) and 0.15 gm high pH liquid buffer ingredient No. 3. The bath is then heated to 180° F. and held for 10 minutes. The cloth scoured by this procedure using high pH liquid buffer ingredient No. 3 to control pH is of comparable cleanliness, brightness, and whiteness to cloth scoured in baths where solid Phosphate pH control agents are used.

A low pH liquid buffer ingredient may be used alone to set the final pH of a bleaching bath from about 6.0 to 8.0. The following example illustrates this operation:

EXAMPLE IV

Into a suitable dyeing beaker containing an agitator, 10 grams of cotton knit are placed in a bath of 200 ml water. Next are added 0.2 gm of a sequesting agent (Plexene 280) (Sybron Chemical Inc.) and 1.2 gm of 35% hydrogen peroxide. The bath is heated to boil at 212° F. and held for one (1) hour. The bath is drained and the cotton washed with 200 ml water and 0.2 gm low pH liquid buffer ingredient No. 2. Then the cotton knit is washed again in 200 ml of water. Neutralizations carried out in this manner with low pH liquid buffer ingredient No. 2 produce comparable results and fabric to neutralizations done with acetic acid, or other solid phosphate pH buffer agents.

A low or high pH buffer ingredient may be used in a wide variety of textile wet processing operations (bleaching, scouring, dyeing, printing or finishing) to neutralize the bath or the fabric. The high pH buffer ingredient would be used to raise an existing low pH, and the low pH buffer ingredient would be used to lower an existing high pH. One example of this type of use would be to neutralize the fabric and dye bath of a polyester/cotton blend after dyeing with the disperse dyes and before dyeing with the direct dyes.

In addition to the above applications of the present invention, low and/or high pH liquid buffer ingredients find usage in a wide variety of industrial non-textile applications where processing in water systems occurs and setting and/or maintaining a desired pH is necessary. For example, solid buffer agents such as MSP or TSP are often used as ingredients in metal working lubricants which are water based. Low pH liquid buffer ingredients Nos. 1 or 2 and/or high pH liquid buffer ingredients Nos. 3 or 6 may be used as the pH controls in these systems and produce comparable results when substituted for MSP or TSP. Solid buffer agents such as MSP or TSP are commonly used as pH control and/or buffers in wet processing of wood pulp in the paper industry. Low pH liquid buffer ingredients Nos. 1 or 2 and/or high pH liquid buffer ingredients Nos. 3 or 6 may be used as the pH control and/or buffer in pulp processing and produce comparable results when substituted for MSP or TSP.

Although particular embodiments of the present invention have been disclosed herein for purposes of explanation, further modifications or variations thereof will be apparent to those skilled in the art to which this invention pertains.

I claim:

1. A premixed low pH liquid buffer suitable for use as a direct textile bath additive which consists essentially of a water solution in the following percent by weight:

Monosodium Phosphate: 13–40

Phosphoric Acid: 5–30

Water: Balance

2. A premixed high pH liquid buffer suitable for use as a direct textile bath additive which consists essentially of a water solution in the following percent by weight:

Tripotassium Phosphate: 20–50

Potassium Hydroxide: 2.5–20

Water: Balance

3. The liquid buffer of claim 2 which contains about 0.4 to 7 percent by weight of sodium hydroxide.

4. The liquid buffer of claims 2 or 3 which contains about 4 to 10 percent by weight of borax pentahydrate.

5. The liquid buffer of claim 4 which contains about 3 to 8 percent by weight of at least one from the group consisting of monoethanolamine, diethanolamine and triethanolamine.

* * * * *